US007495367B2

(12) United States Patent
Braml et al.

(10) Patent No.: US 7,495,367 B2
(45) Date of Patent: Feb. 24, 2009

(54) BRUSH MOUNTING PLATE WITH BRUSH GUIDING PLATES

(75) Inventors: Georg Braml, Landsberg (DE); Ralph Abel, Landsberg (DE); Helmut Burger, Moorenweis (DE)

(73) Assignee: Hilti Aktiengesellschaft, Schaan (LI)

( * ) Notice: Subject to any disclaimer, the term of this patent is extended or adjusted under 35 U.S.C. 154(b) by 358 days.

(21) Appl. No.: 11/314,446

(22) Filed: Dec. 20, 2005

(65) Prior Publication Data

US 2006/0145565 A1 Jul. 6, 2006

(30) Foreign Application Priority Data

Dec. 27, 2004 (DE) ..... 10 2004 062 840

(51) Int. Cl.
*H01R 39/38* (2006.01)

(52) U.S. Cl. ..... 310/242; 310/239; 310/245

(58) Field of Classification Search ..... 310/239, 310/242, 245, 248–249
See application file for complete search history.

(56) References Cited

U.S. PATENT DOCUMENTS

| | | | | |
|---|---|---|---|---|
| 1,693,322 | A | 11/1928 | Stanton | |
| 2,851,622 | A | 9/1958 | Hall | |
| 5,696,418 | A * | 12/1997 | Corbach et al. | 310/239 |
| 6,229,242 | B1 | 5/2001 | Autret | |
| 6,680,556 | B2 * | 1/2004 | Menz et al. | 310/239 |

FOREIGN PATENT DOCUMENTS

| | | | |
|---|---|---|---|
| DE | 3149099 | * | 6/1983 |
| DE | 278676 | A1 | 5/1990 |
| DE | 69803331 | T2 | 8/2002 |
| DE | 102004062840 | B3 | 10/2006 |
| EP | 1675226 | A3 | 6/2006 |
| FR | 2315790 | A1 | 1/1977 |
| FR | 2763753 | * | 5/1997 |
| FR | 2760141 | A1 | 8/1998 |
| GB | 2022932 | * | 12/1979 |
| JP | 5-184104 | * | 7/1993 |
| JP | 2001238408 | A | 8/2001 |
| JP | 2002315271 | * | 10/2002 |
| JP | 2002315273 | * | 10/2002 |
| JP | 2004-222454 | * | 8/2004 |
| WO | WO9530269 | A1 | 11/1995 |

* cited by examiner

*Primary Examiner*—Burton Mullins
(74) *Attorney, Agent, or Firm*—Abelman, Frayne & Schwab

(57) ABSTRACT

A brush mounting plate for a universal motor includes U-shaped brush guiding plates (4) for radially guiding carbon brushes (3) and having radially offset guiding plate feet (5) which extend through associated mounting holes (6) formed in the brush mounting plate (1), with at least two guiding plate feet (5) being spaced at different distances from respective adjacent end surfaces (11*a*, 11*b*) of an associated brush guiding plate (4).

2 Claims, 2 Drawing Sheets

Fig. 1b
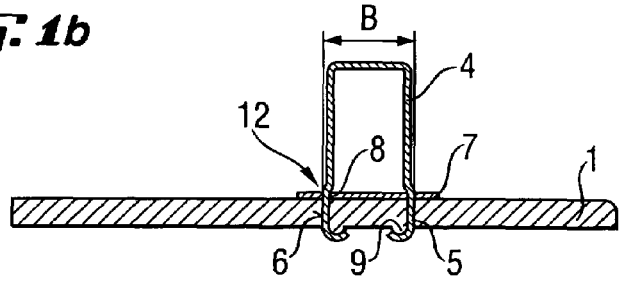
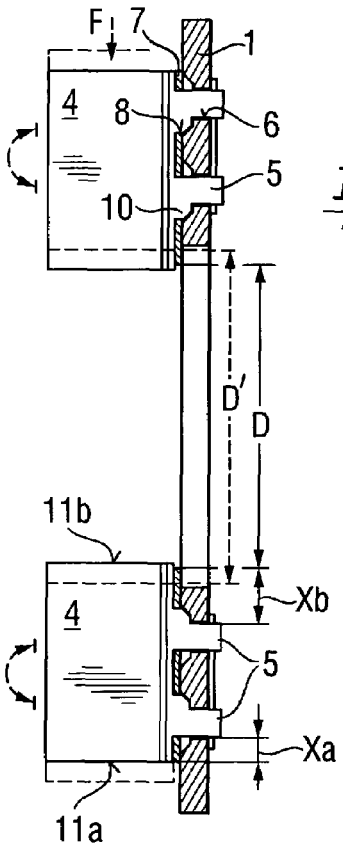
Fig. 1c
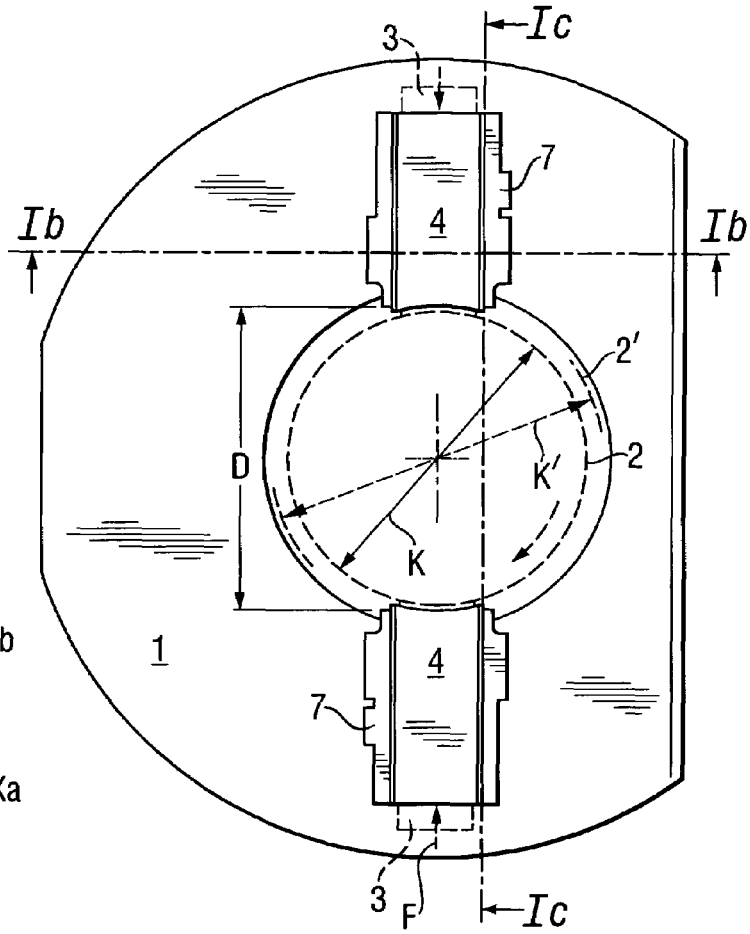
Fig. 1a

Fig. 2b
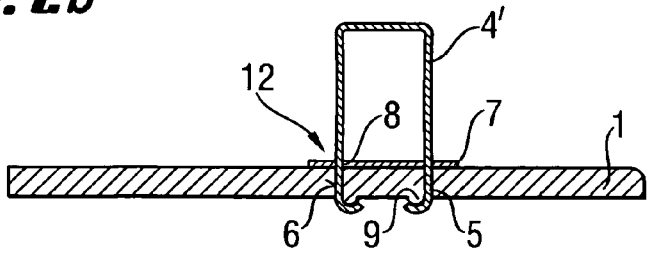
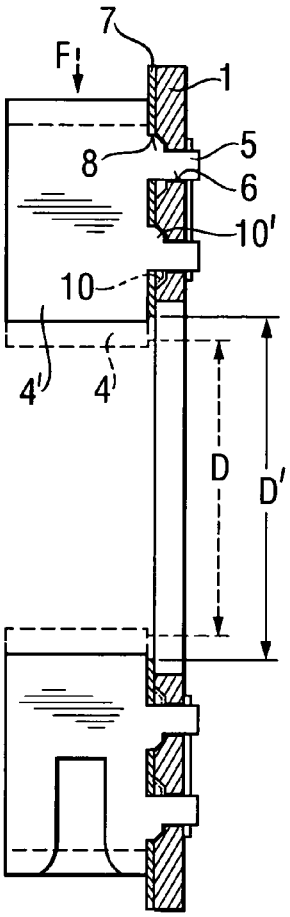
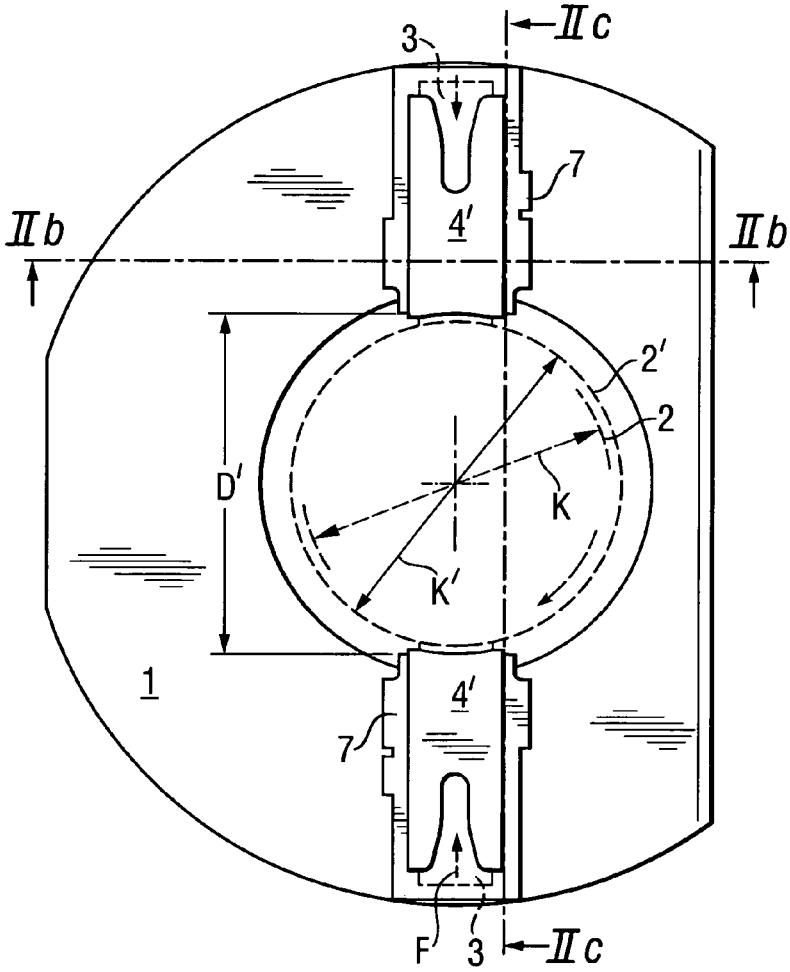
Fig. 2c
Fig. 2a

BRUSH MOUNTING PLATE WITH BRUSH GUIDING PLATES

BACKGROUND OF THE INVENTION

1. Field of the Invention

The present invention relates to a brush mounting plate for a universal motor having brush guiding plates for carbon brushes.

2. Description of the Prior Art

In universal motors, usually, U-shaped brush guiding plates for guiding displaceable carbon brushes are mounted on a brush mounting plate. The brush guiding plates are adapted to a diameter of an associated commutator and the cross-section of the used brushes.

U.S. Pat. Nos. 1,693,322 and 2,851,622 both disclose U-shaped brush guiding plates the flanges of which lie flatly over the mounting holes of the brush mounting plate and which are secured thereto with screws or rivets. The attachment with screws or rivets involves a large number of components and assembly steps.

German publication DD-278676 discloses a straight U-shaped guide plate secured in correspondingly spaced mounting holes in a brush mounting plate.

German Publication DE3149099 discloses U-shaped brush guiding plate having offset feet flatly abutting in a flange-like manner the brush mounting plate and extending through the mounting holes formed in the brush mounting plate. A special fold of the guide plate forms a bottom plate. Such formation of a U-shaped brush guiding plate makes the guiding plate suitable only for a particular commutator diameter.

An object of the present invention is a brush mounting plate which can be used for two different commutator diameters with the use of at least one additional mounting component.

SUMMARY OF THE INVENTION

This and other objects of the present invention, which will become apparent hereinafter are achieved by providing a brush mounting plate for a universal motor and including U-shaped guiding plates for radially guiding carbon brushes and having radially offset guiding plate feet the topology of which is pairwise rotationally symmetrical relative to each other and which extend through associated mounting holes formed in the brush mounting plate, and wherein at least two guiding plate feet are spaced at different distances from respective adjacent thereto end surfaces of an associate brush guiding plate.

With plate feet being spaced at different distances from respective adjacent end surfaces of the brush guiding plate, no pairwise rotational symmetry is achieved.

Thereby, with an alternative mounting of the brush guiding plates in the mounting holes of the same brush mounting plate and with a change of the guide direction by 180°, the radial position of the end surfaces of the guide plates changes and, in particular, the distance of two radially opposite inner guide end surfaces that is associated with a diameter of a commutator of a respective rotor. In this way, the necessary number of different components for producing of universal motors with commutators with different diameters is reduced.

Advantageously, respective bottom plates are arranged between the brush mounting plate and respective guiding plates. The bottom plates have plate holes for respective associated feet of the respective guide plates and through which the associate feet extend.

This insures guidance of the carbon brushes over all four sides along the guide direction with little wear.

Advantageously, at least one foot of each brush guiding plate has a head with an asymmetrical, with respect to the guide direction, width. At least two plate holes of the respective bottom plate are suitably adapted for passing therethrough the foot head with an asymmetrical width. Thereby, dependent on the selection of the guide direction of the guiding plates, two different relative to each other positions, which can correspond to respective commutator diameters, can be obtained with a single bottom plate.

Alternatively, the object of the invention can be achieved with a brush mounting plate for a universal motor that includes U-shaped brush guiding plates for radially guiding carbon brushes and each having plate feet extending through associated mounting holes formed in the brush mounting plate, a bottom plate provided between each brush guiding plate and the brush mounting plate and having holes through which the feet of the brush guiding plate extend, with at least one of the feet having a head widened in a guide direction, with at least one hole of the bottom plate being adapted for passing the widened head of the at least one of the feet therethrough.

With at least one hole in the bottom plate being adapted for passing the widened head of the at least one feet, with an alternative assembly of the same brush mounting plate and with an alternative mounting of the brush guiding plates, pivoted by 180°, the position of the bottom plate relative to a respective brush guiding plate also changes, in particular the distance of two radially opposite inner bottom plate end surfaces, which corresponds to the diameter of a commutator of an associated rotor. In this way, the necessary number of different components for producing universal motors with commutators with different diameters is reduced.

Advantageously, at least one mounting hole of the brush mounting plate is widened in the guide direction at its side facing in the mounting direction, forming a sunk recess at the mounting direction side. Thereby, the widened foot head is at least partially sunk into the brush mounting plate.

Advantageously, each U-shaped brush guiding plate is offset up to a certain width transverse to the guide direction in the foot region of the guiding plate. As a result, the guiding plate feet and mounting holes and, optionally, the holes in the bottom plate are spaced by a greater distance from each other, as necessary for the cross-section of the guided brush. Thus, for universal motors with brushes having different cross-sections, the other brush cross-section only affects the offset variation and, thereby, the brush guiding plate but not the brush mounting plate and the bottom plate rotor. In this way, the necessary number of different components fro producing of universal motors with commutators with different diameters is reduced.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

The drawings show:

FIG. 1*a* a plan view of a brush mounting plate with a rotatable brush guiding plates;

FIG. 1*b* a transverse cross-sectional view of the brush mounting plate along line Ib-Ib in FIG. 1*a;*

FIG. 1*c* a longitudinal cross-sectional view along line Ic-Ic in FIG. 1*a;*

FIG. 2*a* a plan view of an alternatively formed brush mounting plate with a rotatable brush guiding plates;

FIG. 2*b* a transverse cross-sectional view of the brush mounting plate along line IIb-IIb in FIG. 2*a*; and FIG. 2*c* a longitudinal cross-sectional view along line IIc-IIc in FIG. 2*a*.

DETAILED DESCRIPTION OF THE PREFERRED EMBODIMENT

A brush mounting plate 1 according to the present invention for a rotatable universal motor commutator 2 having a small commutator diameter K and which is shown in FIG. 1*a*, has two brush guiding plates 4 for radially guiding both carbon brushes 3, shown with dash lines, in a guide direction F. The guiding plates 4 are spaced radially from each other by a distance D that is somewhat larger than the diameter K of the universal motor commutator 2. The guiding plates 4 are supported on respective bottom plates 7.

As shown in FIG. 1*b*, the U-shaped brush guiding plate 4 is somewhat offset up to a width B transverse to the guide direction F (FIG. 1*a*) in a foot region 12 in the vicinity of its feet 5. The four feet 5 of the guiding plate 4 extend through suitable, associated mounting holes 6 in the brush mounting plate 1 and are bent inward about respective beads 9 formed on the bottom of the brush mounting plate 1. The bottom plate 7, which is located between the brush mounting plate 1 and the brush guiding plate 4, is provided with suitable, associated holes 8 through which the feet 5 of the guiding plate 4 extend.

As shown in FIG. 1*c*, the guiding plate feet 5 are spaced by different distances Xa and Xb from respective adjacent end surfaces 11*a*, 11*b* of the brush guiding plate 4. The four (two are covered) feet 5, which are arranged in a rectangle, are arranged in pairs rotationally symmetrically relative to each other by a half revolution in the guide direction F. The guiding plate feet 5 each has a head having an asymmetrical width with respect to the guide direction F. The holes 8 in the bottom plate 7 are suitably adapted to the asymmetrical width of the heads 10. Also, the four mounting holes 6 in the brush mounting plate 1 are correspondingly widened at the side of the brush mounting plate 1 facing in the mounting direction and form sunk recesses for partially receiving the heads 10 of respective feet 5. A radial distance D, which is somewhat larger than the diameter K of the commutator 2 can be realized during assembly by suitable orientation of both brush guiding plates 4 and the bottom plates 7 relative to the guide direction F. According to FIG. 1*a*, an identical brush mounting plate 1 can be equipped with identical brush guiding plates 4 and the bottom plates 7, with a reverse orientation of both brush guiding plates 4 and the bottom plates 7 relative to the guide direction F (shown with dash lines), for another diameter $K^1$ of a larger universal motor commutator $2^1$ (shown with dash lines).

According to FIG. 2*a*, a brush mounting plate 1 for a rotatable universal motor commutator $2^1$ having a large commutator diameter $K^1$ has two brush guiding plates $4^1$ for radially guiding both carbon brushes 3, shown with dash lines, in a guide direction F. The guiding plates $4^1$ are spaced radially from each other by a distance $D^1$ that is somewhat larger than the diameter $K^1$ of the universal motor commutator $2^1$. The guiding plates $4^1$ are supported on respective bottom plates 7.

According to FIG. 2*b*, the U-shaped brush guiding plate $4^1$ has no offset in its foot region 12 in the vicinity of the guiding plate feet 5. The four feet 5 of the guiding plate $4^1$ extend through suitable, associated mounting holes 6 in the brush mounting plate 1 and are bent inward about respective beads 9 formed on the bottom of the brush mounting plate 1. The bottom plate 7, which is located between the brush mounting plate 1 and the brush guiding plate 4, is provided with suitable, associated holes 8 through which the feet 5 of the guiding plate 4 extend.

As shown in FIG. 2*c*, the guiding plate feet 5 each has a head $10^1$ having an asymmetrical width with respect to the guide direction F. The holes 8 in the bottom plate 7 are suitably adapted to the asymmetrical width of the heads $10^1$. Also, the four mounting holes 6 in the brush mounting plate 1 are widened at the side of the brush mounting plate 1 facing in the mounting direction and form sunk recesses for partially receiving the heads $10^1$ of respective feet 5. With alternatively formed brush guiding plates 4 (shown with dash lines) during the assembly, a radial distance D, which is smaller than the diameter $K^1$ of the commutator $2^1$ is realized. Thus, as shown in FIG. 2*a*, an identical brush mounting plate 1 can be equipped with alternative brush guiding plates 4 with foot heads 10 offset relative to the guide direction F and with identical bottom plates 7 for a smaller diameter K of another commutator 2 (shown partially with dash lines).

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A brush mounting plate for a universal motor, comprising:

U-shaped brush guiding plates (4) for radially guiding carbon brushes (3) and each having plate feet (5) extending through associated mounting holes (6) formed in the brush mounting plate (1); and a bottom plate (7) provided between each brush guiding plate (4) and the brush mounting plate (1) and having holes (8) through which the plate feet (5) of the respective brush guiding plate (4) extend;

wherein at least one of the plate feet (5) has a widened portion with a non-symmetrical head (10') widened only on one side in a guide direction (F), wherein at least one hole (8) of the bottom plate (7) is adapted for passing the widened head (10') of the at least one of the plate feet (5) therethrough;

wherein the widened portion of each of the at least one plate feet (5) is on the same side of the head (10') in a guide direction (F).

2. A brush mounting plate according to claim 1, wherein at least one hole (6) of the brush mounting plate (1) is widened in the guide direction (F) at a side thereof facing in the mounting direction, forming a sunk recess at the mounting direction side.

* * * * *